US009752727B2

(12) United States Patent
Drube et al.

(10) Patent No.: US 9,752,727 B2
(45) Date of Patent: Sep. 5, 2017

(54) HEAT MANAGEMENT SYSTEM AND METHOD FOR CRYOGENIC LIQUID DISPENSING SYSTEMS

(71) Applicant: Chart Inc., Garfield Heights, OH (US)

(72) Inventors: Thomas Drube, Lakeville, MN (US); Petr Zaruba, Decin (CZ)

(73) Assignee: Chart Inc., Garfield Heights, OH (US)

( * ) Notice: Subject to any disclaimer, the term of this patent is extended or adjusted under 35 U.S.C. 154(b) by 446 days.

(21) Appl. No.: 14/092,329

(22) Filed: Nov. 27, 2013

(65) Prior Publication Data

US 2014/0157796 A1 Jun. 12, 2014

Related U.S. Application Data

(60) Provisional application No. 61/731,981, filed on Nov. 30, 2012.

(51) Int. Cl.
*F17C 7/02* (2006.01)

(52) U.S. Cl.
CPC ..... *F17C 7/02* (2013.01); *F17C 2201/054* (2013.01); *F17C 2221/033* (2013.01); *F17C 2223/0161* (2013.01); *F17C 2223/033* (2013.01); *F17C 2225/0161* (2013.01); *F17C 2225/033* (2013.01); *F17C 2227/0135* (2013.01); *F17C 2227/0185* (2013.01);
(Continued)

(58) Field of Classification Search
CPC ..... F17C 7/02; F17C 2270/0168; F17C 2227/0135; F17C 2227/0185;
(Continued)

(56) References Cited

U.S. PATENT DOCUMENTS 5,404,918 A 4/1995 Gustafson
5,590,535 A 1/1997 Rhoades
(Continued)

FOREIGN PATENT DOCUMENTS

EP 10125511 6/2000
WO WO 99/08054 2/1999
WO WO 2010/151107 12/2010

OTHER PUBLICATIONS

Extended European Search Report from EP Application No. 13195167.5 dated Aug. 4, 2015.

*Primary Examiner* — Christopher R Zerphey
(74) *Attorney, Agent, or Firm* — Cook Alex Ltd.; R. Blake Johnston

(57) ABSTRACT

A system for dispensing a cryogenic fluid includes a bulk tank containing a supply of cryogenic fluid. A heating circuit includes an intermediate tank and a heating device and has an inlet in fluid communication with the bulk tank and an outlet. A bypass junction is positioned between the bulk tank and the inlet of the heating circuit. A bypass circuit has an inlet in fluid communication with the bypass junction and an outlet so that a portion of cryogenic fluid from the bulk tank flows through the heating circuit and is warmed and a portion flows through the bypass circuit. A mixing junction is in fluid communication with the outlets of the bypass circuit and the heating circuit so that warmed cryogenic fluid from the heating circuit is mixed with cryogenic fluid from the bypass circuit so that the cryogenic fluid is conditioned. A dispensing line is in fluid communication with the mixing junction so that the conditioned cryogenic fluid may be dispensed. Warmed cryogenic fluid remaining in the heating circuit after dispensing is directed to the intermediate tank and used to warm cryogenic fluid directed through the heating circuit.

23 Claims, 5 Drawing Sheets

(52) U.S. Cl.
CPC ..... *F17C 2227/0304* (2013.01); *F17C 2227/0311* (2013.01); *F17C 2227/0393* (2013.01); *F17C 2250/01* (2013.01); *F17C 2250/0439* (2013.01); *F17C 2250/0631* (2013.01); *F17C 2260/023* (2013.01); *F17C 2265/022* (2013.01); *F17C 2265/032* (2013.01); *F17C 2265/065* (2013.01); *F17C 2270/0168* (2013.01)

(58) Field of Classification Search
CPC ..... F17C 2225/0161; F17C 2250/01; F17C 2227/0304; F17C 2227/0311; F17C 2227/0393; F17C 2260/023; F17C 2265/022; F17C 2265/032; F17C 1/04; F17C 6/00; F17C 2227/0309; F17C 5/06; F17C 7/04
See application file for complete search history.

(56) References Cited

U.S. PATENT DOCUMENTS

| | | | | |
|---|---|---|---|---|
| 5,687,776 | A | 11/1997 | Forgash et al. | |
| 5,771,946 | A * | 6/1998 | Kooy | F17C 6/00 141/11 |
| 6,029,473 | A * | 2/2000 | Bravais | F17C 5/007 62/606 |
| 6,044,647 | A * | 4/2000 | Drube | F17C 7/02 141/2 |
| 6,128,908 | A | 10/2000 | Gustafson | |
| 6,631,615 | B2 | 10/2003 | Drube et al. | |
| 2002/0157402 | A1 | 10/2002 | Drube et al. | |
| 2003/0005709 | A1 * | 1/2003 | Emmer | F17C 5/007 62/50.1 |
| 2012/0137708 | A1 * | 6/2012 | Mackey | F17C 7/02 62/50.1 |

* cited by examiner

HEAT MANAGEMENT SYSTEM AND METHOD FOR CRYOGENIC LIQUID DISPENSING SYSTEMS

CLAIM OF PRIORITY

This application claims priority to U.S. Provisional Patent Application No. 61/731,981, filed Nov. 30, 2012, the contents of which are hereby incorporated by reference.

FIELD OF THE INVENTION

The present invention relates generally to dispensing systems for cryogenic fluids and, in particular, to a heat management system and method for cryogenic liquid dispensing systems.

BACKGROUND

The use of liquid natural gas (LNG) as an alternative energy source for powering vehicles and the like is becoming more and more common as it is domestically available, environmentally safe and plentiful (as compared to oil). A use device, such as an LNG-powered vehicle, typically needs to store LNG in a saturated state in an on-board fuel tank with a pressure head that is adequate for the vehicle engine demands.

LNG is typically dispensed from a bulk storage tank to a vehicle tank by a pressurized transfer. While dispensing systems that saturate the LNG in the bulk tank prior to dispensing are known, they suffer from the disadvantage that continuous dispensing of saturated LNG is not possible. More specifically, dispensing of saturated LNG is not possible during refilling of the bulk tank or during conditioning of newly added LNG.

Another approach for saturating the LNG prior to delivery to a vehicle tank is to warm the LNG as it is transferred to the vehicle tank. Such an approach is known as "saturation on the fly" in the art. Examples of such "saturation on the fly" systems are presented in U.S. Pat. No. 5,687,776 to Forgash et al. and U.S. Pat. No. 5,771,946 to Kooy et al., the contents of which are hereby incorporated by reference.

Both the '776 and '946 patents disclose a bulk tank and a pump that pumps LNG from the bulk tank to a heat exchanger. A bypass conduit is positioned in parallel with the heat exchanger. A mixing valve permits a portion of the LNG stream from the pump to bypass the heat exchanger for mixture with the warmed natural gas exiting the heat exchanger in desired proportions to obtain the desired dispensing temperature for the LNG. The '776 and '946 patents both also disclose positioning an intermediate dispensing tank in circuit between the mixing valve and the dispensing line to the vehicle fuel tank. This permits pressure in the vehicle fuel tank to be relieved as the high pressure fluid from the vehicle fuel tank is returned to the intermediate dispensing tank in order to avoid mixing warm fluid with the cold LNG in the bulk tank.

While the vacuum jacketed intermediate dispensing vessel of the '776 and '946 patents is useful in storing heat from the piping and avoid it going back to the main storage tank, the system is not optimal. More specifically, moving the heat exchanger after an intermediate tank ensures the instantaneous flow of heated mass to the mixing valve while reducing the net volume of gas in the system. Gas is compressible and liquid is very nearly not compressible. As such, large gas volumes in the liquid flow from the pump to the vehicle tank compromise the net flow rate to the vehicle tank creating poor spray action in the tank and the possibility of short fills. A dispensing tank after the heat exchanger, as shown in the '776 and '946 patents, may well be eventually filled with liquid, but for some period of time during use it will have gas in it. While the gas flow through the mixing valve may allow for proper control, the empty vessel creates a problem in the hydraulics of the deliver to the vehicle tank.

Furthermore, saturation on the fly systems can generate a significant amount of unnecessary heat back to the main storage tank. This in turn can result in venting of natural gas, which is undesirable. Liquid left in piping that is of higher saturation than the storage tank will flash and send its heat back to the storage tank. Isolating the piping that is hot helps, but the trapped heat must be properly stored.

A need exists for a system and method for dispensing cryogenic liquids that addresses the above issues.

DETAILED DESCRIPTION OF EMBODIMENTS

While the present invention will be described below in terms of a system and method for dispensing LNG, it is to be understood that they may be used to dispense alternative types of cryogenic liquids or fluids.

Figure 1:
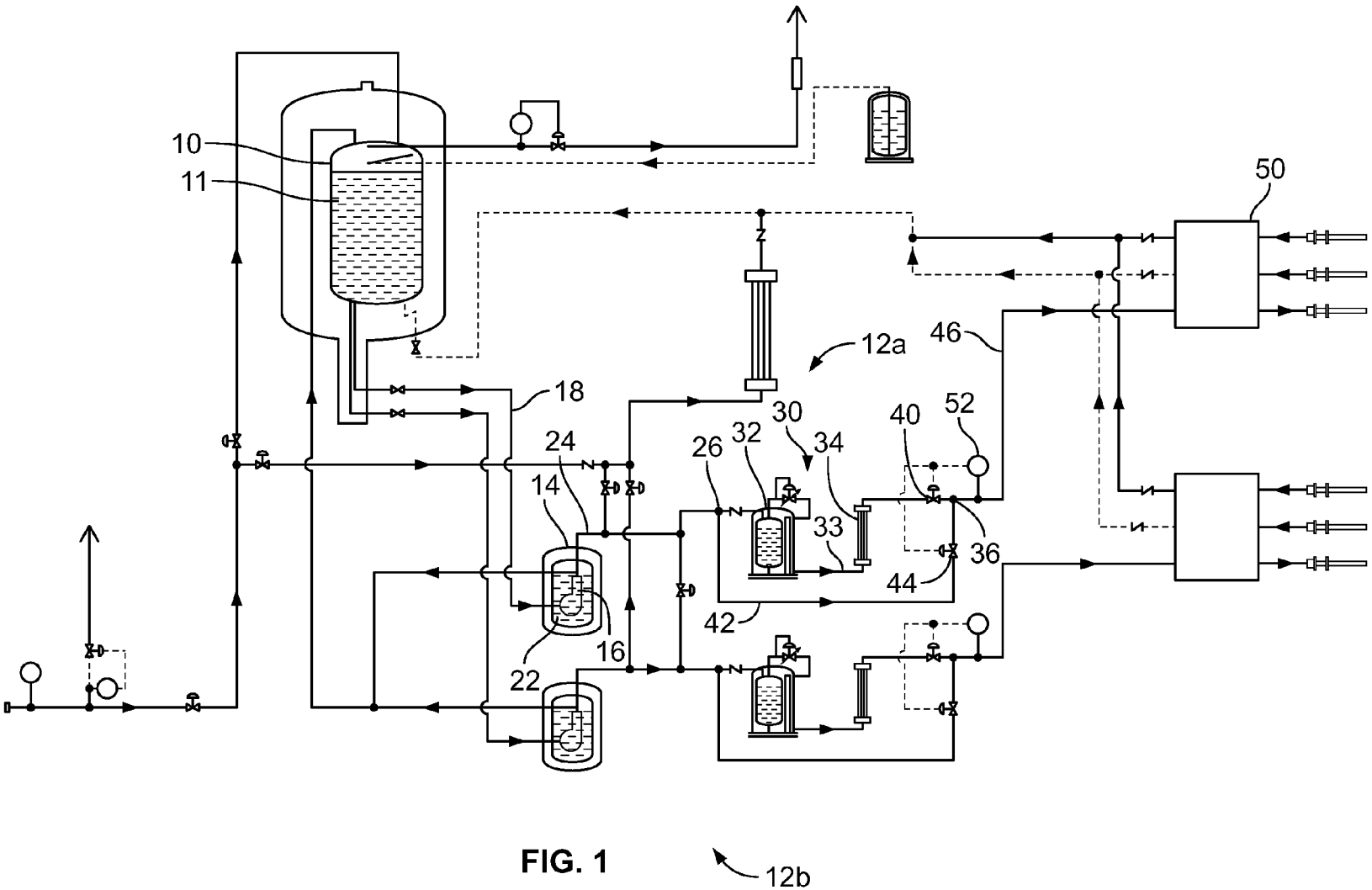
FIG. 1 is a schematic view of a first embodiment of the system of the invention.

As illustrated in FIG. 1, a bulk tank 10 contains a supply of LNG 11. The system includes first and second conditioning and dispensing branches, indicated in general at 12*a* and 12*b*, respectively. While the system will be described with respect to branch 12*a*, it is to be understood that branch 12*b* operates in a similar fashion. LNG from bulk tank 10 travels to a sump 14 containing a pump 16 via line 18. Both the bulk tank and the sump are preferably insulated. Sump 14 contains LNG 22 which is pumped via pump 16 through line 24 to a bypass junction 26.

A heating circuit, indicated in general at 30, includes an intermediate tank 32 and a heat exchanger 34. More specifically, an inlet of an intermediate tank or capacitor (explained below) 32, which is preferably insulated, communicates with bypass junction 26. The outlet of intermediate tank 32 communicates via line 33 with the inlet of a heat exchanger 34, which may be an ambient heat exchanger or any other device for heating cryogenic liquids known in the art. The outlet of heat exchanger 34 communicates with mixing junction 36 through mixing valve 40. A bypass circuit includes a conduit 42 that has an inlet that communicates with junction 26 and an outlet that communicates with junction 36. The bypass conduit 42 is also provided with bypass valve 44. Mixing valve 40 and bypass valve 44 may be, for example, two-way valves. A single, 3-way valve positioned at the mixing junction, such as 3-way valve 110 of FIGS. 3A-3C, could be used in place of the mixing and bypass valves 40 and 44. Dispensing line 46 leads from mixing junction 36 to dispenser 50.

Intermediate tank 32 preferably features an ullage tank and preferably is of the construction illustrated in commonly assigned U.S. Pat. No. 5,404,918 or 6,128,908, both to Gustafson, the contents of both of which are hereby incorporated by reference.

During operation, LNG is pumped to a higher pressure and to junction 26, and a portion travels to intermediate tank 32, while the remaining portion travels through bypass conduit 42. The intermediate tank 32 is filled to a level permitted by the ullage tank. LNG from the intermediate tank 32 flows to the heat exchanger 34, either during filling of the intermediate tank or after the intermediate tank reaches the level permitted by the ullage tank. LNG traveling to the heat exchanger is warmed therein and the resulting liquid or vapor flows to the mixing junction 36 to mix with the cold LNG flowing to the mixing junction by way of the bypass conduit 42. Mixing and bypass valves 40 and 44 are automated and are controlled by a temperature sensor 52, which may include a processor or other controller device, so that the amount of heat added to the cold LNG at junction 36 results in the flow of saturated or supercooled LNG to dispenser 50 through dispensing line 46.

Figure 3A:
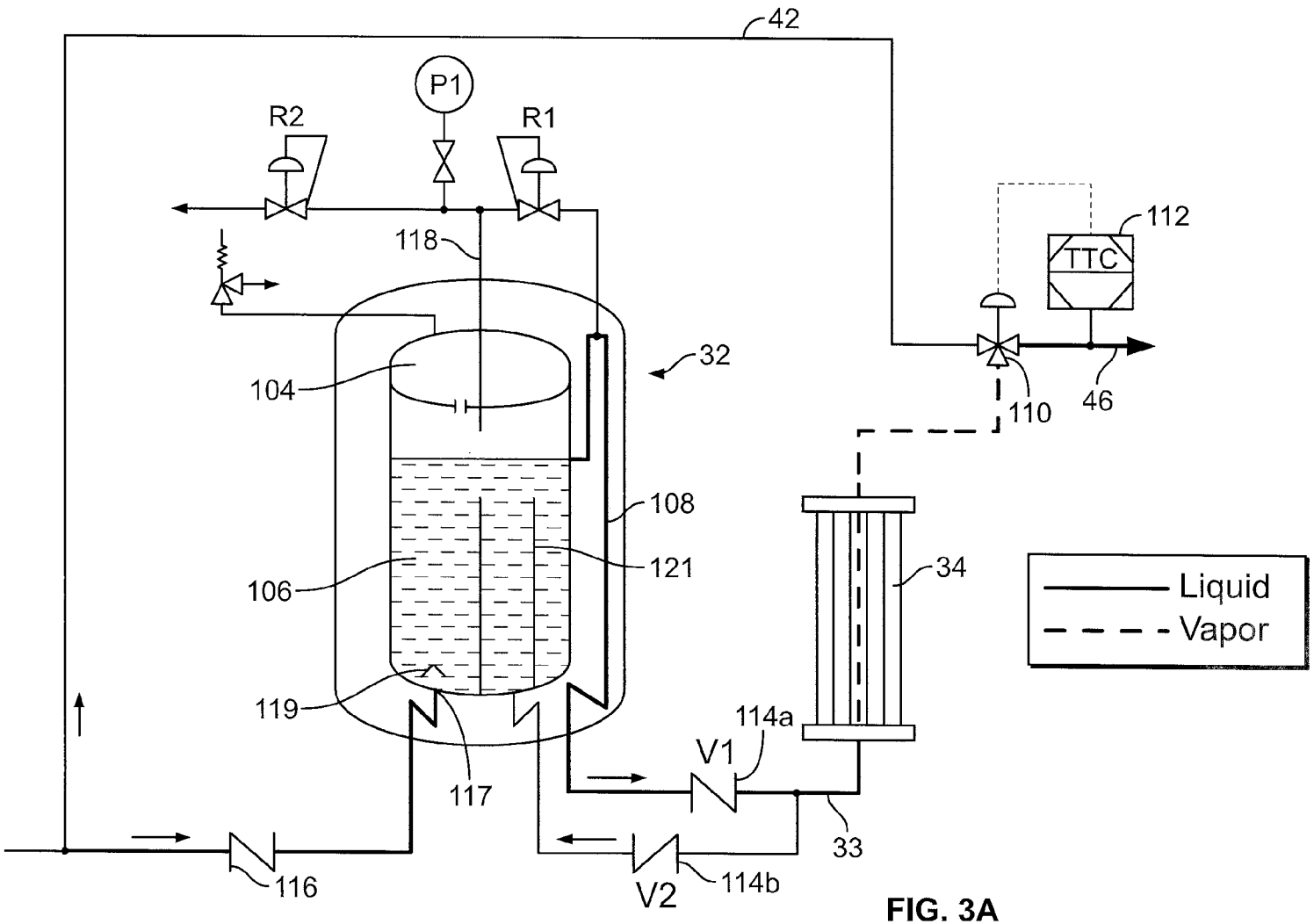
FIGS. 3A-3C are schematic views illustrating details of an optional embodiment of the intermediate tank or capacitor of the system of FIG. 1.
Figure 3B:
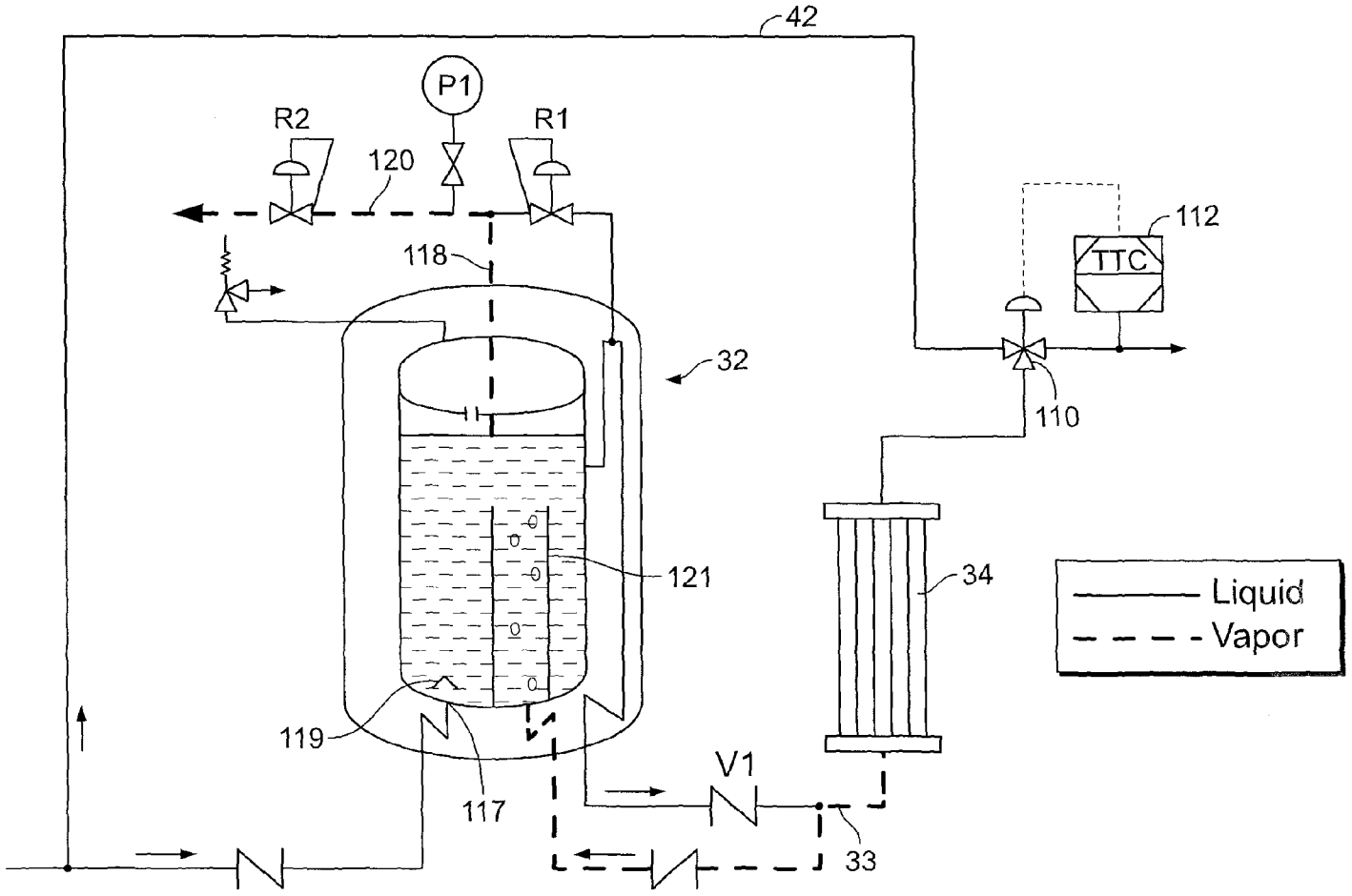
Figure 3C:
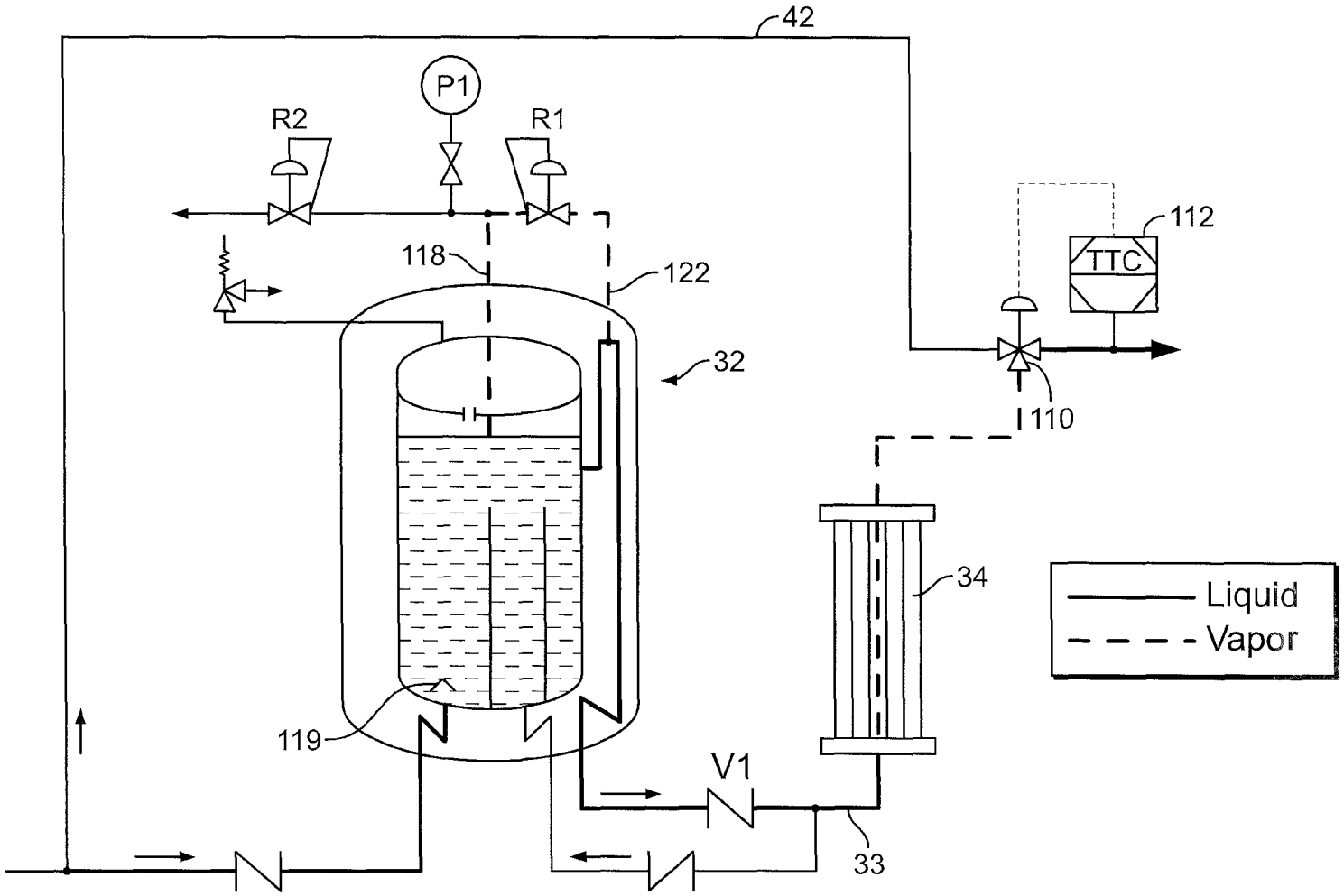

As illustrated in FIGS. 3A and 3C, the heat exchanger 34 is preferably designed and sized to vaporize all of the LNG that flows to it from the intermediate tank 32. As a result, warm natural gas vapor flows to the mixing junction to mix with the cold LNG from bypass conduit 42. The amount of heat added typically must be varied if the flow rate is to be stable and at a high level. Systems that use ambient heat exchangers that are full of liquid have a relatively fixed heat rate. The fixed heat rate and the fixed total mass flow means that regardless of the fraction of flow diverted through the heat exchanger, the resulting heat per unit mass is unchanged (and accordingly the saturation pressure). In such a case the only way to further heat up the fluid is to slow down the total mass flow rate. This can cause problems with efficient spray filling if the flow rate drops too much. The embodiment of FIGS. 1 and 3A-3C takes the flow of liquid (by way of the heat battery or intermediate tank 32) and by design vaporizes it (heat exchanger 34 is large enough to do this). By so configuring the heat exchanger, the amount of heat can be varied because the flow rate diverted through the path with the heat exchanger in turn drives the distance into which the cryogenic temperature is present. The mixing at the mixing junction 36 is then a cold LNG and a relatively (approaching ambient potentially) warm natural gas vapor. The net result is a warmer liquid.

After dispensing, the warm LNG in line 33 running between the intermediate tank outlet and the inlet of the heat exchanger 34, and the warm LNG in the line running between the outlet of heat exchanger 34 and the mixing valve 40, drains back to the intermediate tank 32 for use in pre-warming LNG prior to the heat exchanger during the next dispensing cycle or run. As a result, the intermediate tank acts as a thermal battery or thermal capacitor. During the next dispensing run, LNG is diverted at junction 26 through both the intermediate tank 32 (which adds the stored heat to the LNG) and the heat exchanger 34 (which adds more heat). As a result, a smaller heat exchanger may be used because the intermediate tank shares some of the heating burden.

Furthermore, after dispensing, warm LNG in the line 46 boils and travels back to the bulk tank via the vent line running from dispenser 50 to the bottom of bulk tank 10. Nevertheless, by returning the heated LNG between the intermediate tank 32 and the mixing valve 40 back to the intermediate tank, the amount of vapor going back to heat the bulk tank is reduced.

A properly sized intermediate tank 32 at the discharge of the pump 16 and the heat exchanger 34 after the tank allows for designs that keep the intermediate tank essentially full of liquid during normal operation. The intermediate tank is also sized such that the thermal mass of the stored liquid therein can accommodate the boil back from the heat exchanger or vaporizer thereby storing the heat for the next saturation request, and not send it back to the main storage bulk tank 10.

Figure 2:
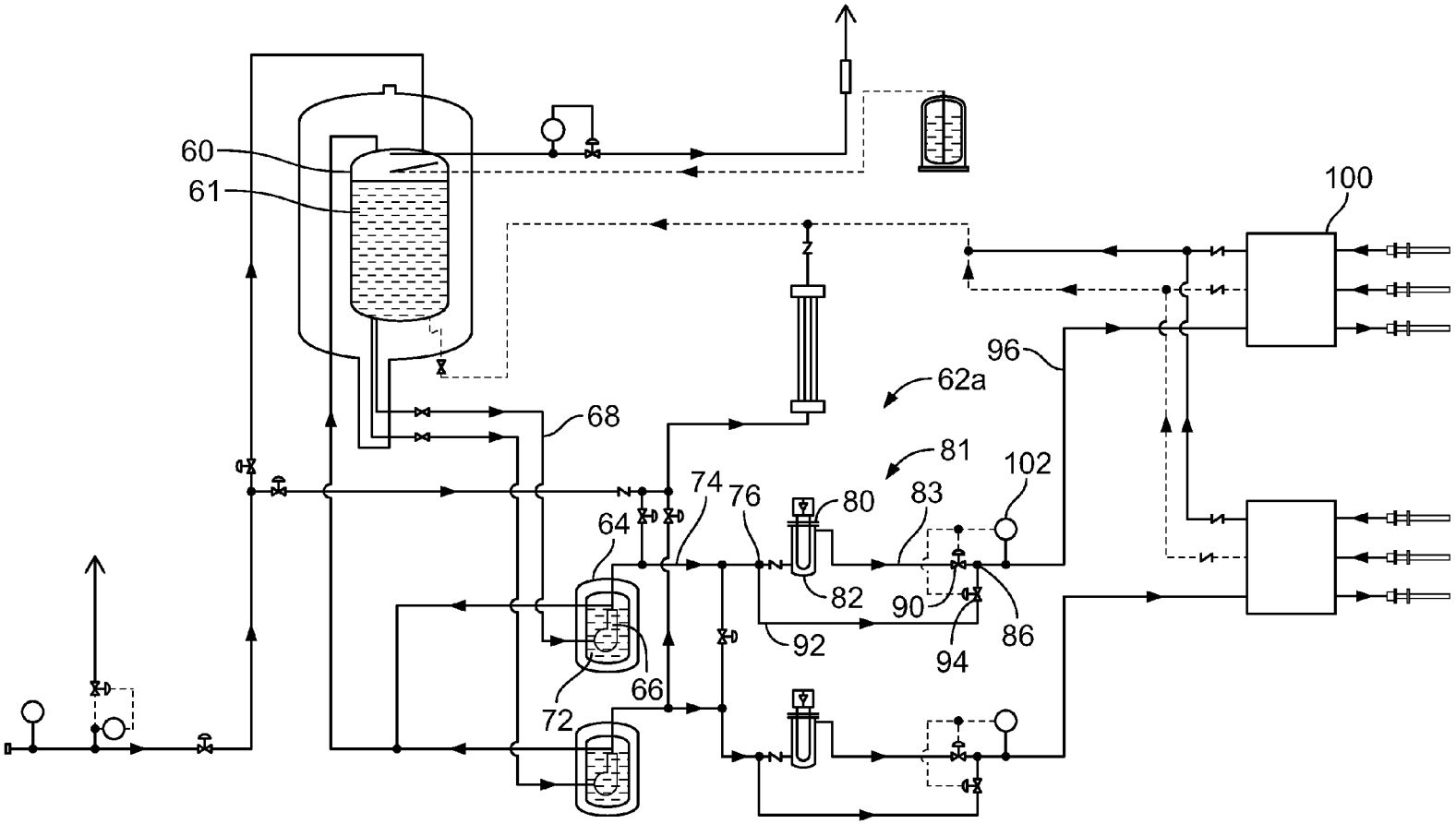
FIG. 2 is a schematic of a second embodiment of the system of the invention.

In a second embodiment of the system of the invention, illustrated in FIG. 2, an internal electric heater 82 is added to the intermediate tank or capacitor 80 of the heating circuit, indicated in general at 81. The volume of the capacitor then serves to store the heat from conditioning for later use, but also serves as a thermal mass to make the mixing event instant in that the tank will hold liquid at higher than needed temperature and pressure allowing for controllable mixing. The heater 82 is integral to and not preceding the intermediate storage tank 80. As a result, the intermediate tank acts as a sort of "water heater" with respect to the LNG and needs to be sized so that hot LNG exits the intermediate tank when LNG is diverted into the intermediate tank. Heaters other than electric heaters known in the art may be substituted for electric heater 82.

The remaining portion of the system of FIG. 2 acts in the same manner as the system of FIG. 1. More specifically, as illustrated in FIG. 2, a bulk tank 60 contains a supply of LNG 61. The system includes first and second conditioning and dispensing branches, indicated in general at 62*a* and 62*b*, respectively. While the system will be described with respect to branch 62*a*, it is to be understood that branch 62*b* operates in a similar fashion. LNG from bulk tank 60 travels to a sump 64 containing a pump 66 via line 68. Both the bulk tank and the sump are preferably insulated. Sump 64 contains LNG 72 which is pumped via pump 66 through line 74 to junction 76. An inlet of an intermediate tank or capacitor 80, which is preferably insulated, communicates with junction 76. As described above, intermediate tank or capacitor 80 contains an electric heater 82. The outlet of intermediate tank 80 communicates via line 83 with mixing junction 86 through mixing valve 90. A bypass conduit 92 has an inlet that communicates with junction 76 and an outlet that communicates with junction 86. The bypass conduit 92 is also provided with bypass valve 94. Mixing valve 90 and bypass valve 94 may be, for example, two-way valves. A single, 3-way valve positioned at the mixing junction, as illustrated at 110 in FIGS. 3A-3C, however, could be used in place of the mixing and bypass valves 90 and 94. Line 96 leads from mixing junction 86 to dispenser 100.

During operation, LNG is pumped to a higher pressure and to junction 76, and a portion travels to intermediate tank or capacitor 80, while the remaining portion travels through bypass conduit 92. LNG from the intermediate tank 80 flows, after being warmed therein by heater 82, flows to the mixing junction 86 to mix with the cold LNG flowing to the mixing junction by way of the bypass conduit 92. Mixing and bypass valves 90 and 94 are automated and are controlled by a temperature sensor 102, which may include a processor or other controller device, so that the amount of heat added to the cold LNG at junction 86 results in the flow of saturated or supercooled LNG to dispenser 100 through dispensing line 96.

After dispensing, the warm LNG in line 83 running between the intermediate tank outlet and the mixing valve 90, drains back to the intermediate tank 80 for use in warming LNG, with the aid of heater 82 during the next dispensing cycle or run. As a result, the intermediate tank 80 also acts as a thermal battery or thermal capacitor. During the next dispensing run, LNG is diverted at junction 76 through the intermediate tank 80, which adds the stored heat to the LNG plus heat from heater 82.

Furthermore, after dispensing, warm LNG in the line 96 boils and travels back to the bulk tank via the vent line running from dispenser 100 to the bottom of bulk tank 60. Nevertheless, by returning the heated LNG between the intermediate tank 80 and the mixing valve 90 back to the intermediate tank, the amount of vapor going back to heat the bulk tank is reduced.

With regard to selection between the systems of FIGS. 1 and 2, the intermediate tank 32 of the system of FIG. 1 is larger and may create fog due to the ambient heat exchanger 34. In contrast, the intermediate tank 80 and heater 82 of FIG. 2 is more expensive but fogless.

Turning to FIGS. 3A-3C, an optional embodiment of intermediate tank 32 is presented. As illustrated in FIG. 3A, the intermediate tank 32 includes an ullage tank defining ullage space 104. The intermediate tank contains a supply of LNG 106 provided from the pump (16 in FIG. 1) through check valve 116.

As will now be explained, the intermediate tank or capacitor 32 of FIGS. 3A-3C uses a minimal stratification in the tank. FIG. 3A shows a normal filling or dispensing operation. The inlet of cold LNG from the pump is to the bottom of the intermediate tank 32, through check valve 116. The LNG enters the bottom of tank 32 through opening 117, which is provided with a baffle 119 to keep fresh liquid in the lower part of the tank. Liquid offtake to the heater 34 through the check valve 114*a* and line 33 is from the upper warmer layer of the intermediate tank via line 108. Return of warm liquid and gas from the heater is through the check valve 114*b* to the mixing zone inside a tube 121 in the intermediate tank. There may optionally be a screen with small holes for better recondensation of gas and with outlet of warmer liquid, via the tube, in the upper part of the intermediate tank. R1 is the economizer regulator. R2 is a boil off regulator for venting of excessive pressure after a longer stand-by back to the bottom of the bulk tank.

During the normal fill or dispensing, the incoming LNG can push the vapor through the liquid outlet of the tank (the inlet of line 108) in the upper part of the tank, and to heat exchanger 34 and to the mixing valve 110, which is under the control of temperature sensor 112. Incoming LNG (through check valve 116) will fill the intermediate tank with the liquid up to the inlet of line 108. The position of the inlet to line 108 could also partly determine the ullage to provide an embodiment without the ullage tank. Maximum liquid level would be between the inlet to line 108 and the inlet to the line 118 leading to R1/R2.

FIG. 3B illustrates operation after a dispensing cycle or run. More specifically, as described above with reference to FIG. 1, after dispensing, the warm LNG in line 33 running between the intermediate tank outlet and the inlet of the heat exchanger 34, and the warm LNG in the line running between the outlet of heat exchanger 34 and the mixing valve 110, drains back to the intermediate tank 32 for use in pre-warming LNG prior to the heat exchanger during the next dispensing cycle or run. As a result, the intermediate tank acts as a thermal battery or thermal capacitor. The gas from the heat exchanger saturates the LNG in the intermediate tank and a pressure rise in the capacitor 32 occurs. Excessive vapor/liquid travels to the bulk tank through lines 118 and 120 and boil off regulator R2.

FIG. 3C illustrates a fill or dispensing at pressure higher than the setting of economizer regulator R1. The excessive liquid/vapor from the capacitor 32 travels through line 118, the economizer regulator R1 and line 122 where it joins the LNG traveling to the heat exchanger 34 via line 33. Any evaporation of saturated LNG in the capacitor due to the drop in pressure travels to the ullage space 104 (FIG. 3A).

While the preferred embodiments of the invention have been shown and described, it will be apparent to those skilled in the art that changes and modifications may be made therein without departing from the spirit of the invention, the scope of which is defined by the appended claims.

What is claimed is:

1. A system for dispensing a cryogenic fluid comprising;

a) a bulk tank adapted to contain a supply of liquid cryogenic fluid;

b) a heating circuit including an intermediate tank, a heating device, and a first line connecting the intermediate tank to the heating device, said heating circuit having an inlet and an outlet;

c) a bypass circuit having an inlet and an outlet;

d) a bypass junction positioned between, and in fluid communication with, the bulk tank, the inlet of the heating circuit and the inlet of the bypass circuit, said bypass junction configured to receive liquid cryogenic fluid from the bulk tank and:

i. direct a first portion of received liquid cryogenic fluid through the inlet of the heating circuit so that the first portion of received liquid cryogenic fluid travels through the heating circuit and is warmed to produce a warmed cryogenic fluid; and ii. direct a second portion of received liquid cryogenic fluid through the inlet of the bypass circuit so that the second portion of received liquid cryogenic fluid travels through the bypass circuit;

e) a mixing junction in fluid communication with the outlets of the bypass circuit and the heating circuit, said mixing junction configured so that warmed cryogenic fluid from the heating circuit is mixed with liquid cryogenic fluid from the bypass circuit so that the cryogenic liquid from the bypass circuit is conditioned;

f) a dispensing line in fluid communication with the mixing junction; and g) said heating circuit configured so that warmed liquid cryogenic fluid remaining in the heating circuit between the intermediate tank and the mixing junction, after conditioned cryogenic fluid is dispensed through the dispensing line, is returned to the intermediate tank via a second line to warm liquid cryogenic fluid directed through the heating circuit during future dispensing.

2. The system of claim 1 wherein the bypass circuit includes a bypass conduit.

3. The system of claim 1 further comprising a pump having an inlet in fluid communication with the bulk tank and an outlet in fluid communication with the bypass junction.

4. The system of claim 1 wherein the intermediate tank is insulated and contains an ullage tank.

5. The system of claim 1 further comprising a temperature sensor in communication with cryogenic fluid flowing out of the mixing junction and wherein the heating circuit includes a mixing valve that is controlled by the temperature sensor.

6. The system of claim 5 further comprising a bypass valve positioned in the bypass circuit and that is controlled by the temperature sensor.

7. The system of claim 1 further comprising a temperature sensor in communication with cryogenic fluid flowing out of the mixing junction and wherein the mixing junction includes a 3-way mixing valve.

8. The system of claim 1 wherein the heating device of the heating circuit includes a heat exchanger having an inlet and an outlet with the inlet of the heat exchanger in fluid communication with an outlet of the intermediate tank, so that liquid cryogenic fluid from the intermediate tank is warmed in the heat exchanger to produce the warmed cryogenic fluid, and the outlet of the heat exchanger in communication with the mixing junction.

9. The system of claim 8 wherein the heat exchanger is an ambient heat exchanger that is adapted to vaporize all liquid cryogenic fluid flowing into the heat exchanger from the intermediate tank so that vapor cryogenic fluid produced by the heat exchanger is directed to the mixing junction so that an amount of heat added from the vapor cryogenic fluid to liquid cryogenic fluid traveling through the bypass circuit is variable through variance of the portion of liquid cryogenic fluid traveling through the heating circuit from the bypass junction.

10. The system of claim 8 further comprising a temperature sensor in communication with cryogenic fluid flowing out of the mixing junction and a mixing valve that is controlled by the temperature sensor, said mixing valve positioned between an outlet of the heat exchanger and the mixing junction.

11. The system of claim 1 wherein the heating device of the heating circuit includes a heater positioned within the intermediate tank.

12. The system of claim 11 wherein the heater is an electric heater.

13. The system of claim 1 wherein the liquid cryogenic fluid is liquid natural gas.

14. A system for dispensing a cryogenic fluid comprising:

a) a bulk tank containing a supply of cryogenic fluid;

b) a heating circuit including an intermediate tank, a heating device, and a first line connecting the intermediate tank to the heating device, said heating circuit having an inlet and an outlet;

c) a bypass junction positioned between, and in fluid communication with, the bulk tank and the inlet of the heating circuit;

d) a bypass circuit having an inlet in fluid communication with the bypass junction and an outlet so that a first portion of cryogenic fluid from the bulk tank flows through the heating circuit and is warmed while a second portion of cryogenic fluid from the bulk tank flows through the bypass circuit;

e) a mixing junction in fluid communication with the outlets of the bypass circuit and the heating circuit so that warmed cryogenic fluid from the heating circuit is mixed with cryogenic fluid from the bypass circuit so that the cryogenic fluid from the bypass circuit is conditioned;

f) a dispensing line in fluid communication with the mixing junction so that the conditioned cryogenic fluid may be dispensed; and g) said heating circuit configured so that warmed liquid cryogenic fluid remaining in the heating circuit between the intermediate tank and the mixing junction, after conditioned cryogenic fluid is dispensed through the dispensing line, is returned vi a second line to the intermediate tank to warm liquid cryogenic fluid directed through the heating circuit during future dispensing.

15. The system of claim 14 wherein the bulk tank provides liquid cryogenic fluid to the bypass junction and the heating device is an ambient heat exchanger wherein all liquid cryogenic fluid directed through the heat exchanger is vaporized so that liquid cryogenic fluid directed though the bypass circuit is conditioned with vapor cryogenic fluid at the mixing junction so that an amount of heat added from the vapor cryogenic fluid to liquid cryogenic fluid traveling through the bypass circuit is variable through variance of the portion of liquid cryogenic fluid traveling through the heating circuit from the bypass junction.

16. The system of claim 15 wherein the liquid cryogenic fluid is liquid natural gas and the vapor cryogenic fluid is natural gas vapor.

17. The system of claim 14 further comprising a temperature sensor in communication with cryogenic fluid flowing out of the mixing junction and a mixing valve in fluid communication with the heating circuit that is controlled by the temperature sensor.

18. A method of dispensing a cryogenic fluid comprising the steps of:

a) providing a supply of the liquid cryogenic fluid a heating circuit having an intermediate tank and a heating device connected by a first line, a bypass circuit in parallel with the heating circuit, and a bypass junction positioned between, and in liquid communication with, the supply of liquid cryogenic fluid and inlets of the bypass and heating circuits;

b) directing liquid cryogenic fluid from the supply of the liquid cryogenic fluid to the bypass junction;

c) directing a first portion of liquid cryogenic fluid from the bypass junction through the heating circuit;

d) warming the first portion of liquid cryogenic fluid directed through the heating circuit using the heating device to produce a warmed cryogenic fluid;

e) directing a second portion of liquid cryogenic fluid from the bypass junction through the bypass circuit while the first portion of liquid cryogenic fluid is directed through the heating circuit;

f) mixing, at a mixing junction, the warmed first portion of cryogenic fluid from the heating circuit with the second portion of liquid cryogenic fluid from the bypass circuit to condition the second portion of liquid cryogenic fluid to produce a conditioned cryogenic fluid;

g) dispensing the conditioned cryogenic fluid, h) directing warmed liquid cryogenic fluid remaining in the heating circuit between the intermediate tank and the mixing junction after dispensing to the intermediate tank to warm the liquid cryogenic fluid in the intermediate tank via a second line; and i) using the warmed liquid cryogenic fluid in the intermediate tank of step h) to warm the first portion of liquid cryogenic fluid directed through the heating circuit during a future performance of steps c) through g).

19. The method of claim 18 wherein the liquid cryogenic fluid is liquid natural gas.

20. The method of claim 19 wherein the heating device vaporizes the liquid natural gas directed to the heating circuit so that natural gas vapor is mixed with the liquid natural gas from the bypass circuit in step f).

21. The system of claim 8 wherein each of the first and second lines are a in fluid communication with the outlet of the intermediate tank and the inlet of the heat exchanger, said first line including a first check valve configured to permit liquid cryogenic fluid to flow from a liquid side of the intermediate tank to the heat exchanger, and said second line including a check valve configured to permit liquid cryogenic fluid to flow from the heat exchanger to the liquid side of the intermediate tank.

22. The system of claim 1 wherein the heating circuit, is configured so that warmed liquid cryogenic fluid remaining in the heating circuit between the intermediate tank and the mixing junction, after conditioned cryogenic fluid is dispensed through the dispensing line, is returned to a liquid side of the intermediate tank without flowing through a head space of the intermediate tank.

23. The system of claim 1 further comprising a pump having an inlet and an outlet, said pump positioned between the bulk tank and the bypass junction and configured so that liquid cryogenic fluid liquid from the bulk tank is pumped to the bypass junction.

* * * * *